US011009211B1

(12) United States Patent
Zhong

(10) Patent No.: US 11,009,211 B1
(45) Date of Patent: May 18, 2021

(54) FOLDING LAMPSHADE

(71) Applicant: Yao Cong Zhong, Dongguan (CN)

(72) Inventor: Yao Cong Zhong, Dongguan (CN)

( * ) Notice: Subject to any disclaimer, the term of this patent is extended or adjusted under 35 U.S.C. 154(b) by 0 days.

(21) Appl. No.: 16/905,472

(22) Filed: Jun. 18, 2020

(30) Foreign Application Priority Data

Jun. 2, 2020 (CN) ..... 202020977420.6

(51) Int. Cl.
*F21V 1/06* (2006.01)

(52) U.S. Cl.
CPC ..... *F21V 1/06* (2013.01)

(58) Field of Classification Search
CPC ..... F21V 1/06
See application file for complete search history.

(56) References Cited

U.S. PATENT DOCUMENTS 4,290,099 A * 9/1981 Vicars-Harris ..... F21V 1/06 362/352
2005/0111228 A1* 5/2005 Chen ..... F21V 17/007 362/352
2006/0239012 A1* 10/2006 Bin ..... F21V 1/06 362/352
2018/0129034 A1* 5/2018 Wilson ..... A45D 29/00

* cited by examiner

*Primary Examiner* — Mary Ellen Bowman
(74) *Attorney, Agent, or Firm* — Wang Law Firm, Inc.

(57) ABSTRACT

A folding lampshade includes a lampshade fabric, a lower ring and an upper ring. The inner sides of both upper and lower edges of the lampshade fabric are respectively and movably connected to the lower ring and the upper ring. The upper ring includes three divided curved ring bodies, and the middle of the upper ring has a hardware connector, and the hardware connector is connected to the upper ring through the three support link-rods, and the support link-rod has an end rotatably installed onto the hardware connector and the other end connected to opposite free ends adjacent to the two curved ring bodies by a T-shaped hardware interface part. The structural design of this invention movably connects the lampshade fabric with the upper ring, so that the upper ring can be detachably connected to the hardware connector through the T-shaped hardware interface part.

3 Claims, 14 Drawing Sheets

FOLDING LAMPSHADE

FIELD OF THE INVENTION

The present invention relates to the technical field of lamps, and more particularly to a folding lampshade.

BACKGROUND OF THE INVENTION

Lampshade is an important part of a lamp, and its function not just improves the lighting effect only, but also serves as home decoration. To cope with the change in people's pursuit of beauty, new materials are introduced continuously to achieve the effects of controlling the cost, simplifying the manufacturing process, saving packaging and transportation fees and facilitating users' installation. Therefore, various different types of lampshades are introduced constantly.

A conventional lampshade generally includes a lampshade fabric, an upper iron ring and a lower iron ring, and the inner sides of the upper and lower edges of the lampshade fabric have a U-shaped rubber strip, and the U-shaped rubber strip has an inner groove curvature matched with the external circumference of the upper iron ring and the lower iron ring, and the upper iron ring is fixed to the lampshade fabric by the U-shaped rubber strip on the inner side of the upper edge of the lampshade fabric, and the lower iron ring is fixed to the lampshade fabric by the U-shaped rubber strip on the inner side of the lower edge of the lampshade fabric; and a Velcro tape is set on the left and right folding edges for connecting both left and right edges respectively; and the middle of the lower iron ring has an UNO plate mounted thereon for fixing a lamp holder, and the UNO plate is welded and fixed to the lower iron ring through the support link-rod. Although the support stand and cover of the lampshade of this kind can be detached easily, the total volume is still very large which incurs a larger transportation space and a higher transportation cost. Obviously, the conventional lampshade fails to meet the increasingly stricter requirements of modern industry and transportation and definitely requires further improvements.

SUMMARY OF THE INVENTION

In view of the aforementioned deficiencies of the prior art, it is a primary objective of the present invention to provide a folding lampshade with the features of small volume, small footprint, and low transportation cost To achieve the aforementioned and other objectives, the present invention discloses a folding lampshade, comprising: a lampshade fabric, a lower ring, and an upper ring, characterized in that the inner sides of both upper and lower edges of the lampshade fabric are respectively and movably coupled to the upper ring and the lower ring, and the upper ring comprises three divided curved ring bodies, a hardware connector disposed at the middle of the upper ring coupled to the upper ring by the hardware connector, and a support link-rod having an end rotatably installed to the hardware connector and the other end coupled to opposite free ends adjacent to the two curved ring bodies.

Preferably, the inner sides of both upper and lower edges of the lampshade fabric have a 9-shaped silicone buckle with an inner groove curvature matched with the external circumference of the lower ring and the upper ring.

Preferably, the lower ring comprises three divided lower curved ring bodies, and two adjacent lower curved ring bodies are coupled with each other by a PP plastic interface part.

Preferably, the hardware connector comprises an upper hardware plate and a lower hardware plate disposed at the top and bottom thereof respectively, and a rivet is passed through the upper hardware plate, an end of the support link-rod, and the lower hardware plate sequentially to connect the upper hardware plate, the end of the support link-rod and the lower hardware plate together.

Compared with the prior art, the present invention has the following advantages:

The aforementioned structural design of this invention movably connects the lampshade fabric with the upper ring, so that the upper ring can be detachably connected to the hardware connector through the T-shaped hardware interface part, and the hardware connector is detachably coupled, so that the three support link-rods movably coupled to the hardware connector can be folded and stored together with the three divided curved ring bodies and the three T-shaped hardware interface parts. Therefore, the invention has the features of small volume, small footprint, low transportation cost, convenient transportation, and simple installation and removal.

DESCRIPTION OF THE PREFERRED EMBODIMENTS

The technical characteristics of the present invention will become apparent with the detailed description of preferred embodiments accompanied with the illustration of related drawings. It is intended that the embodiments and drawings disclosed herein are to be considered illustrative rather than restrictive.

Figure 1:
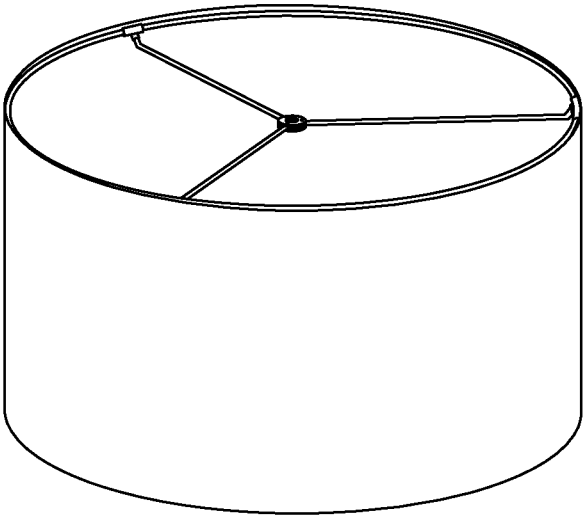
FIG. 1 is a schematic view of a first embodiment of the present invention.
Figure 2:
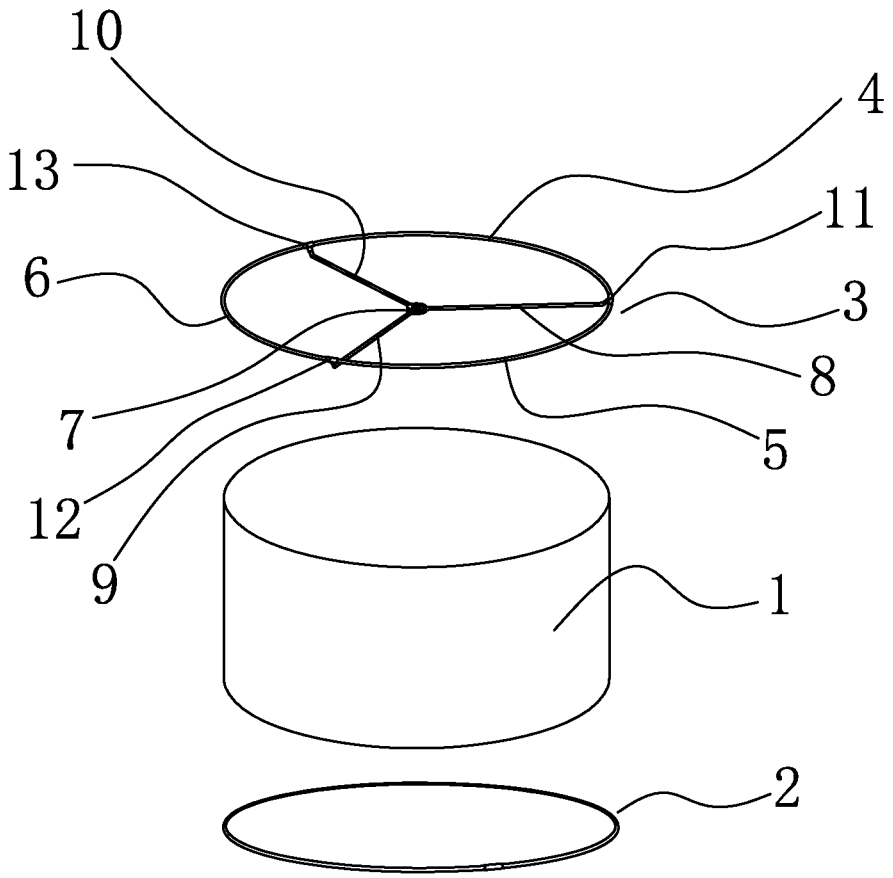
FIG. 2 is an exploded view of the first embodiment of the present invention.
Figure 3:
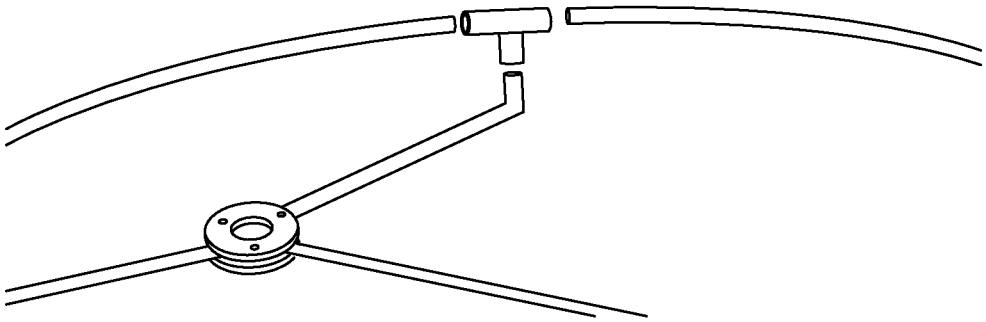
FIG. 3 is an exploded view of the first embodiment of the present invention showing a support link-rod connected to a part of an upper ring.
Figure 4:
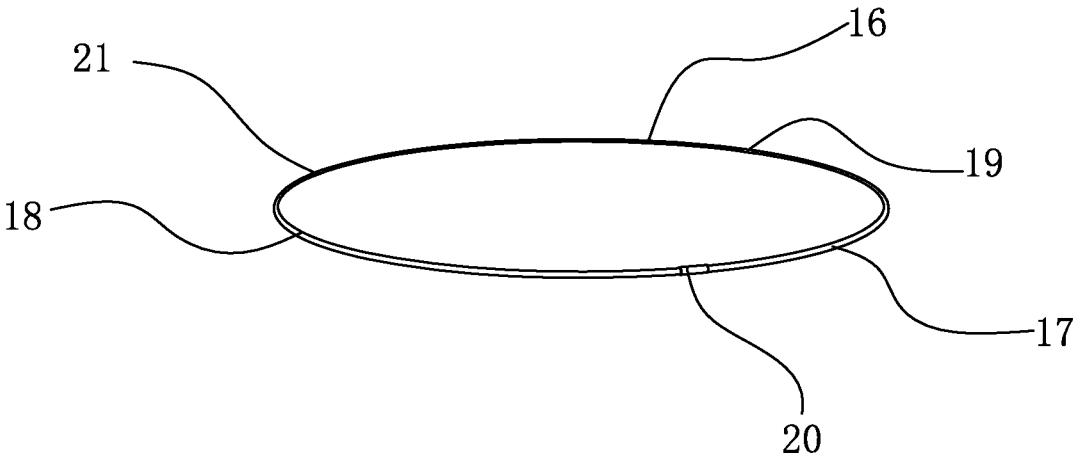
FIG. 4 is a schematic view of a lower ring of the first embodiment of the present invention.
Figure 5:
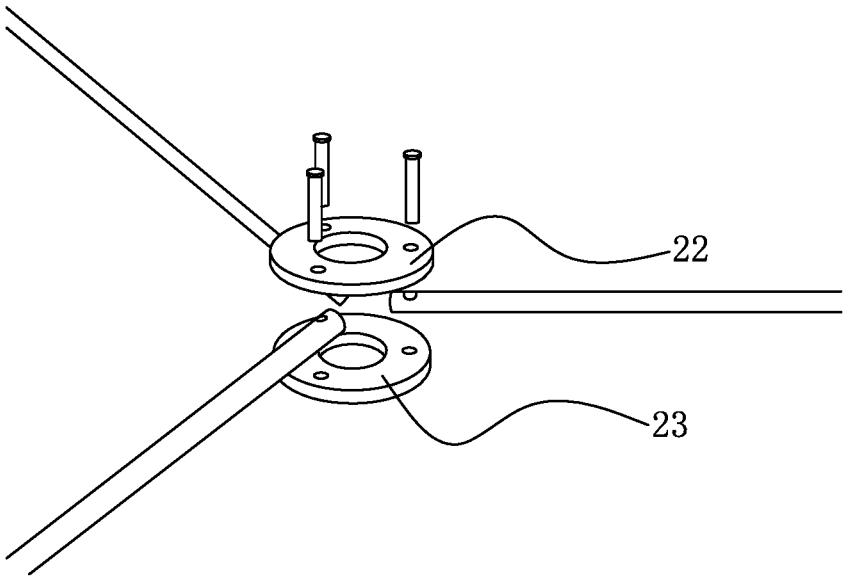
FIG. 5 is an exploded view of a hardware connector and a support link-rod of the first embodiment of the present invention.
Figure 6:
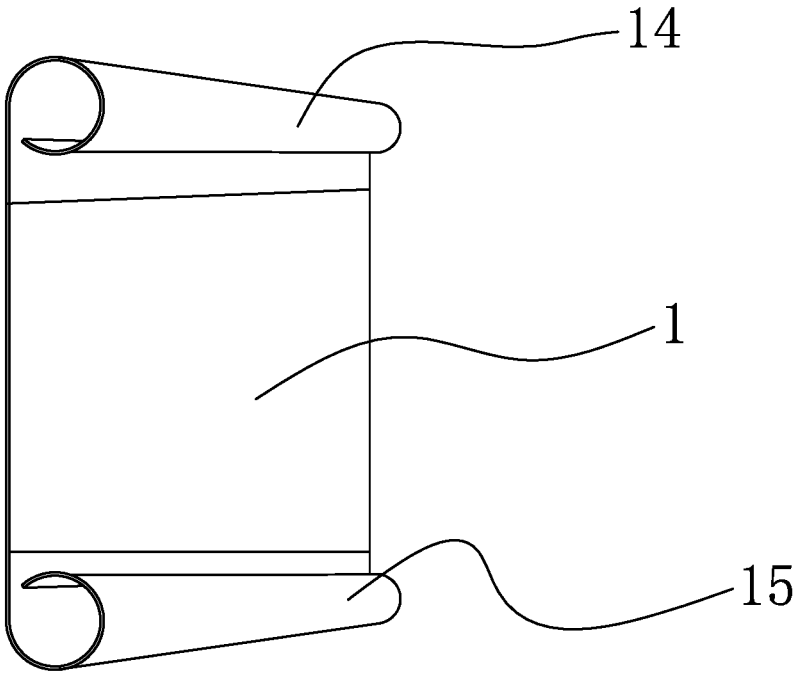
FIG. 6 is a schematic view of a lampshade fabric of the first embodiment of the present invention.
Figure 7:
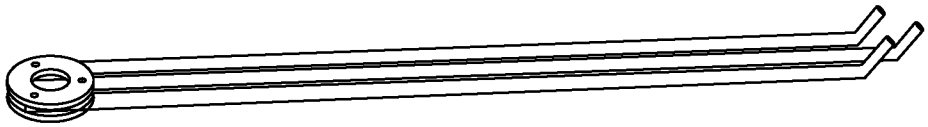
FIG. 7 is a schematic view of a hardware connector and a support link-rod being folded and stored in accordance with the first embodiment of the present invention.

With reference to FIGS. 1 to 7 for a folding lampshade in accordance with the first embodiment of the present invention, the folding lampshade comprises a lampshade fabric 1, a lower ring 2 and an upper ring 3, wherein the inner sides of both lower and upper edges of the lampshade fabric 1 are respectively and movably coupled to the lower ring 2 and the upper ring 3, and the upper ring 3 comprises three divided curved ring bodies 4, 5, 6, and the middle of the upper ring has a hardware connector 7 coupled to the upper ring 3 through the three support link-rods 8, 9, 10, and the support link-rod 8 has an end rotatably installed onto the hardware connector 7 and the other end coupled to opposite free ends adjacent to the two curved ring bodies 4, 5 through a T-shaped hardware interface part 11, and the support link-rod 9 has an end rotatably installed onto the hardware connector 7 and the other end coupled to free ends adjacent to the two curved ring bodies 4, 5 through a T-shaped hardware interface part 12, and the support link-rod 9 has an end rotatably installed onto the hardware connector 7 and the other end coupled to free ends adjacent to the two curved ring bodies 6, 4 through a T-shaped hardware interface part 13.

The inner sides of both upper and lower edges of the lampshade fabric 1 have a 9-shaped silicone buckle 14, 15, and the 9-shaped silicone buckles 14, 15 has an inner groove curvature matched with the external circumference of the lower ring 2 and the upper ring 3.

The lower ring 2 comprises three divided lower curved ring bodies 16, 17, 18, and the two adjacent lower curved ring bodies 16, 17 are coupled to each other by a PP plastic interface part 19, and the two adjacent lower curved ring bodies 17, 18 are coupled to each other by a PP plastic interface part 20, and the two adjacent lower curved ring bodies 18, 16 are coupled to each other by a PP plastic interface part 21.

The hardware connector 7 comprises an upper hardware plate 22 and a lower hardware plate 23 disposed at the top and bottom thereof respectively, and a rivet is passed through the upper hardware plate, an end of the support link-rod, and the lower hardware plate sequentially to couple the three together.

In this embodiment, the support link-rod includes a long level section and a short inclined section integrally formed with the long level section, and the short inclined section is inserted into the T-shaped hardware interface part.

In this embodiment, the lampshade fabric is movably coupled to the upper ring through the 9-shaped silicone buckle, so that the upper ring can be separated from the lampshade fabric easily, and the lampshade fabric can be rolled individually. The upper ring is detachably coupled to the hardware connector through the T-shaped hardware interface part, and the hardware connector is rotatably coupled to the support link-rod. During transportation, any one of the two support link-rods can be rotated in order to fold and store with the third support link-rod together, and the three divided curved ring bodies can be folded and stored together, and the three T-shaped hardware interface parts can be folded and stored together. The three divided lower curved ring bodies of the lower ring can be detachably coupled through the PP plastic interface part. Similarly, during transportation, the three divided lower curved ring bodies can be folded and stored together, and the three PP plastic interface parts can be folded and stored together. Therefore, this invention has the features of small volume, small footprint, low transportation cost, convenient transportation, and simple installation and removal.

Figure 8:
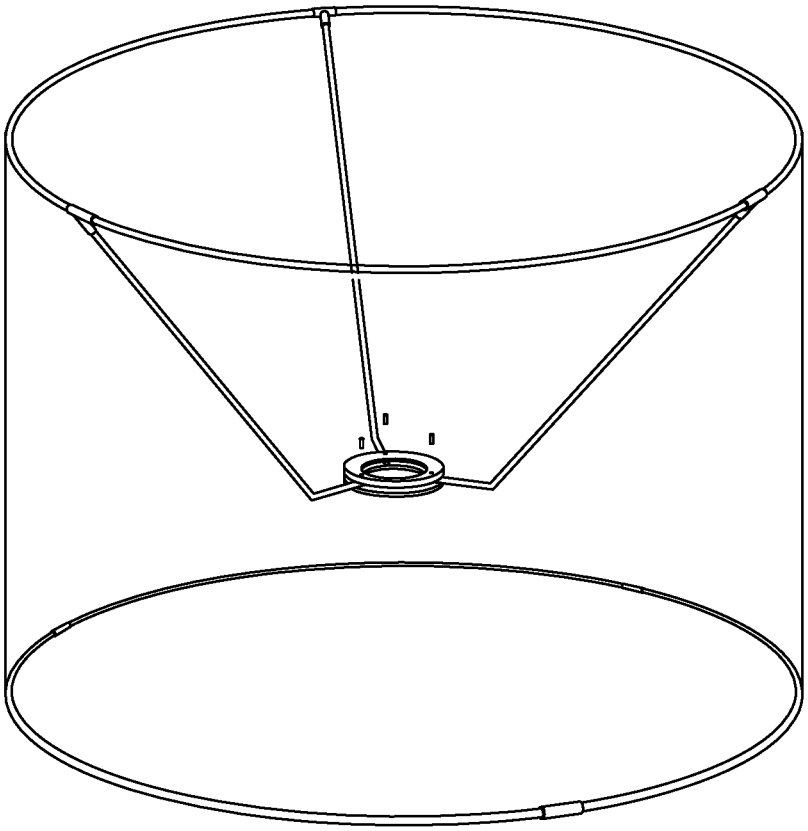
FIG. 8 is a schematic view of a second embodiment of the present invention.
Figure 9:
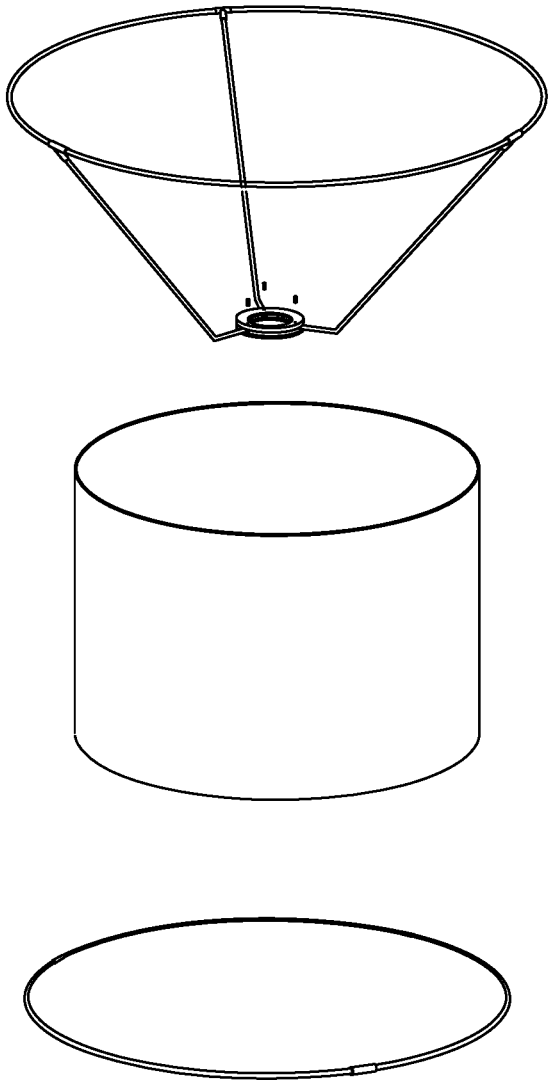
FIG. 9 is an exploded view of the second embodiment of the present invention.
Figure 10:
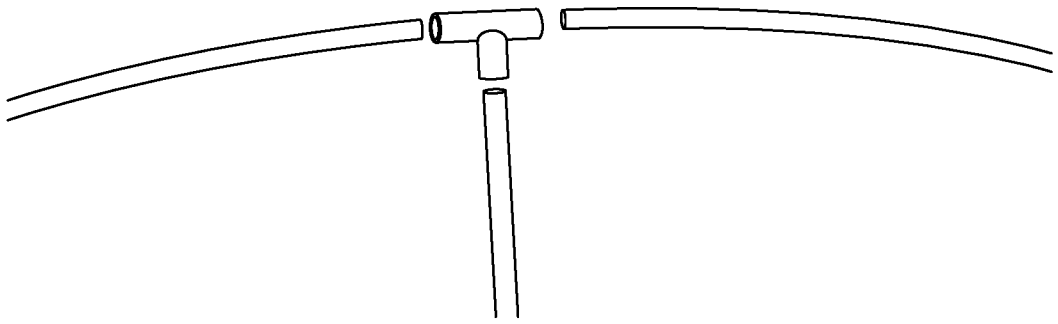
FIG. 10 is an exploded view of a hardware connector, a support link-rod and an upper ring of the second embodiment of the present invention.
Figure 11:
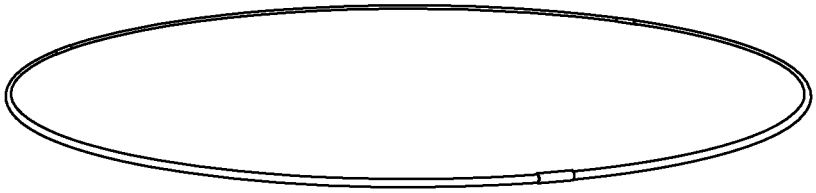
FIG. 11 is a schematic view of a lower ring of the second embodiment of the present invention.
Figure 12:
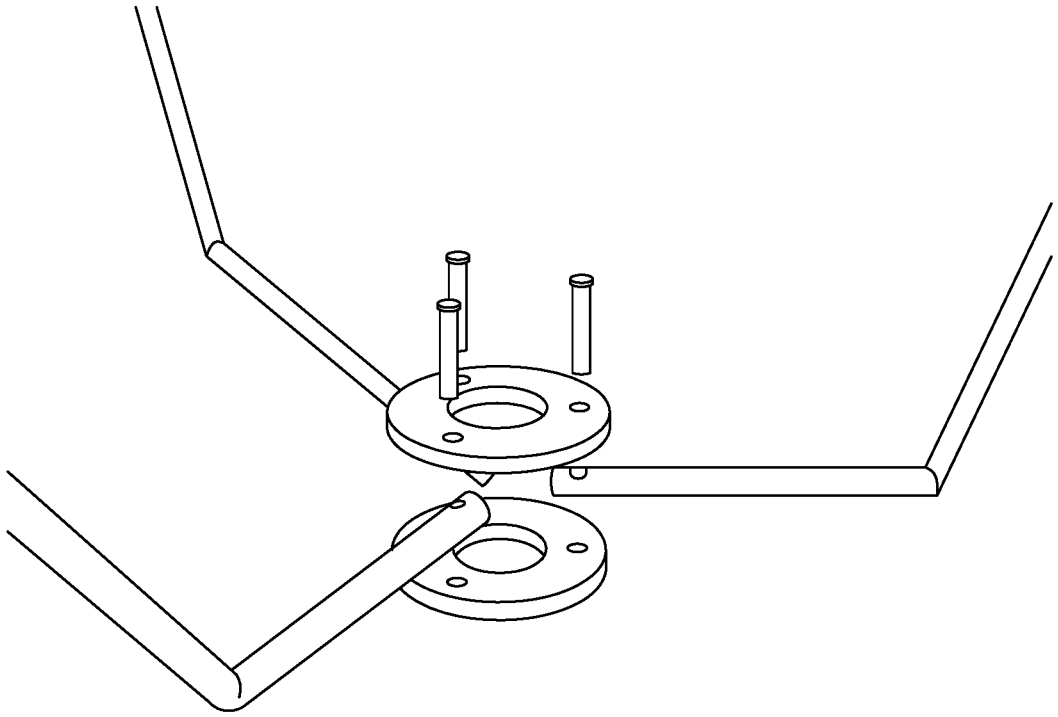
FIG. 12 is an exploded view of a hardware connector and a support link-rod of the second embodiment of the present invention.
Figure 13:
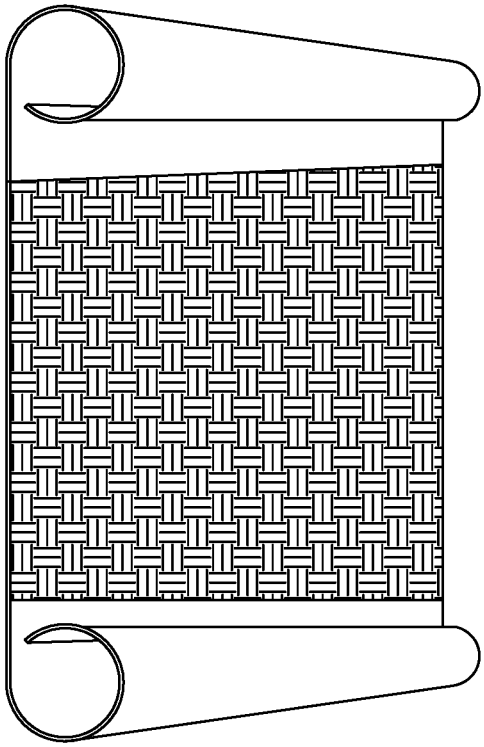
FIG. 13 is a schematic view of a lampshade fabric of a second embodiment of the present invention.
Figure 14:
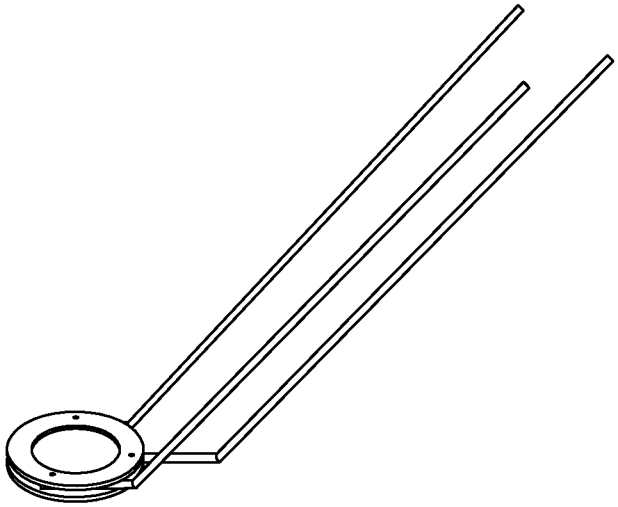
FIG. 14 is a schematic view of a hardware connector and a support link-rod being folded and stored in accordance with the second embodiment of the present invention.

With reference to FIGS. 8 to 14 for the second embodiment of the present invention, the difference between the second embodiment and the first embodiment resides on that the support link-rod of the second embodiment includes a short level section and a long inclined section integrally formed with the short level section, and the long inclined section is inserted into the T-shaped hardware interface part.

In summation of the description above, the present invention with the aforementioned structural design overcomes the deficiencies of the prior art and has the advantages of small footprint, low transportation cost, etc.

While the invention has been described by means of specific embodiments, numerous modifications and variations could be made thereto by those skilled in the art without departing from the scope and spirit of the invention as set forth in the claims.

What is claimed is:

1. A folding lampshade, comprising a lampshade fabric, a lower ring, and an upper ring, characterized in that inner sides of both upper and lower edges of the lampshade fabric are respectively and movably coupled to the upper ring and the lower ring, and the upper ring comprises three divided curved ring bodies, a hardware connector disposed at a center of the upper ring coupled to the upper ring by the hardware connector, wherein the hardware connector comprises an upper hardware plate and a lower hardware plate disposed at the top and bottom thereof respectively, and a support link-rod having an end rotatably installed to the hardware connector and an opposite end coupled to opposite free ends adjacent to the two curved ring bodies, and a rivet connects the upper hardware plate, the end of the support link-rod, and the lower hardware plate together by sequentially passing through the upper hardware plate, the end of the support link-rod, and the lower hardware plate.

2. The folding lampshade as claimed in claim 1, wherein the inner sides of both upper and lower edges of the lampshade fabric have a 9-shaped silicone buckle with an inner groove curvature matched with the external circumference of the lower ring and the upper ring.

3. The folding lampshade as claimed in claim 1, wherein the lower ring comprises three divided lower curved ring bodies, and two adjacent lower curved ring bodies are coupled with each other by a PP plastic interface part.

* * * * *